US008117669B2

(12) United States Patent
Cox

(10) Patent No.: US 8,117,669 B2
(45) Date of Patent: Feb. 21, 2012

(54) BIB-SCARF SYSTEM

(76) Inventor: Susan Gabriel Cox, Greensboro, NC (US)

( * ) Notice: Subject to any disclaimer, the term of this patent is extended or adjusted under 35 U.S.C. 154(b) by 18 days.

(21) Appl. No.: 12/589,087

(22) Filed: Oct. 19, 2009

(65) Prior Publication Data

US 2011/0088133 A1 Apr. 21, 2011

(51) Int. Cl.
*A41D 11/00* (2006.01)
*A41B 13/10* (2006.01)

(52) U.S. Cl. ..... 2/49.1; 2/49.5; 2/52; 2/75

(58) Field of Classification Search ..... 2/49.1–49.5, 2/52, 48, 51, 207, 144, 137, 145, 146, 91, 2/111, 75, 80, 46, 117, 121, 122, 118–120, 2/102, 50, 77, 115, 69, 114, 92, 94, 103–107; D2/861; 24/9; 224/270
See application file for complete search history.

(56) References Cited

U.S. PATENT DOCUMENTS

| | | | | | |
|---|---|---|---|---|---|
| 383,847 | A | * | 6/1888 | Baker | 24/9 |
| 383,929 | A | * | 6/1888 | Whittingham | 2/144 |
| 964,755 | A | * | 7/1910 | Charon | 2/150 |
| 1,151,126 | A | * | 8/1915 | Robinson | 2/91 |
| 1,297,474 | A | * | 3/1919 | Jones | 2/80 |
| 1,405,744 | A | * | 2/1922 | Sampliner | 2/91 |
| 1,435,147 | A | * | 11/1922 | Burns | 2/80 |
| 1,473,789 | A | * | 11/1923 | Killfeather | 2/75 |
| 1,521,228 | A | * | 12/1924 | Clamage | 2/72 |
| 1,609,332 | A | * | 12/1926 | Van Nest | 2/48 |
| 1,647,385 | A | * | 11/1927 | Voorsanger | 2/48 |
| 1,669,983 | A | * | 5/1928 | Humphrey | 24/9 |
| 1,731,137 | A | * | 10/1929 | Jones | 2/74 |
| 1,749,333 | A | * | 3/1930 | Fridolph | 2/46 |
| 1,821,185 | A | * | 9/1931 | Luery | 2/74 |
| 1,878,604 | A | * | 9/1932 | Rodeback | 2/150 |
| 2,163,857 | A | * | 6/1939 | Smith | 2/102 |
| 2,413,319 | A | * | 12/1946 | Golfieri | 2/171.01 |
| 2,423,581 | A | * | 7/1947 | Clark | 2/48 |
| 2,501,010 | A | * | 3/1950 | Seidenbaum | 2/48 |
| 2,508,472 | A | * | 5/1950 | Scully | 2/145 |
| 2,568,826 | A | * | 9/1951 | Roussos | 2/244 |
| 2,809,375 | A | * | 10/1957 | Doron | 2/91 |
| 2,914,771 | A | * | 12/1959 | Slavin | 2/48 |
| 3,276,037 | A | * | 10/1966 | Englehaupt | 2/146 |
| 3,439,360 | A | * | 4/1969 | Grubman | 2/155 |
| 3,733,614 | A | * | 5/1973 | Abramowitz | 2/144 |
| 3,946,444 | A | * | 3/1976 | Parrilla | 2/144 |
| 4,318,189 | A | * | 3/1982 | Intengan | 2/144 |
| D364,032 | S | * | 11/1995 | Caley | D2/861 |

(Continued)

FOREIGN PATENT DOCUMENTS

JP 2006291401 * 10/2006

*Primary Examiner* — Amy B Vanatta

(57) ABSTRACT

A bib-scarf system which is simple to manufacture and creates an adjustable, nonplanar bib. The system incorporates a piece of fabric, a horizontal opening in the fabric, and a horizontal strap. The fabric is cut to a predetermined rectangular size. Then a horizontal opening is created in the center of the fabric. The fabric at the top of the newly created horizontal opening is folded over and pulled through the opening. A strap is then run through the horizontal opening and fold in the top half of the fabric. This process creates an adjustable nonplanar bib which can be attached to the wearer with the strap either worn around the neck or secured to a garment which receives the strap.

6 Claims, 12 Drawing Sheets

U.S. PATENT DOCUMENTS

| | | | | |
|---|---|---|---|---|
| 6,408,439 | B1 * | 6/2002 | Garforth-Crippen | 2/80 |
| 7,032,247 | B2 * | 4/2006 | Frieswick et al. | 2/49.1 |
| 7,043,764 | B2 * | 5/2006 | Sky | 2/49.1 |
| 7,409,726 | B2 * | 8/2008 | Bahm et al. | 2/49.1 |
| 7,665,151 | B1 * | 2/2010 | Finell | 2/49.1 |
| 7,685,648 | B2 * | 3/2010 | Kenney | 2/48 |
| 2006/0026728 | A1 * | 2/2006 | Shaw | 2/49.1 |
| 2007/0017004 | A1 * | 1/2007 | Sims-Perry | 2/207 |
| 2007/0022518 | A1 * | 2/2007 | Sheu | 2/207 |
| 2009/0089910 | A1 * | 4/2009 | Lopez | 2/52 |

* cited by examiner

BIB-SCARF SYSTEM

BACKGROUND OF THE INVENTION

Currently there are a plethora of bibs. All are intended to protect the article below the bib from being soiled. Most of the bibs are planar and of a fixed size and must be attached around the neck of the wearer. The problem with the planar shape is that it allows for the drool from the wearer to drip down the chin and onto the wearer. The problem with attaching the bib around the neck is twofold. First, the wearer, if a baby of 3 months or older, pulls the bib either off or turns it around where it no longer provides adequate protection and, secondly, the neck size is different and thus is either too small or too large.

There are products to address the planar concern. I cite U.S. Pat. No. 7,269,856. This bib creates a non planar bib by sewing a section of filled material on a traditional planar bib. While this may address the food and drool from sliding down the bib, it does not address the adjustability of the material to be draped directly around the neck and up under or on the chin which is needed when bottle feeding, to prevent the drool from sliding around the mouth and down the side of the upper neck. In summary it is a static crescent form and thus not adjustable horizontally or vertically as needed.

The problem with attaching the bib around the neck has been solved by either creating a garment with an attached bib, (Cite U.S. Pat. Nos. 6,216,269 7,032,247) or by using a pull-over bib which has a front and back with a neck opening. It is pulled over the head like a tee shirt. The pull over bib comes in an assortment of materials and sizes. The problem with the bib that pulls over the head is that the wearer must be somewhat upright to pull the bib off. It is also limited to pulling it off from the back to the front or the spills on the front go all over the face and head of the user. The problem with attaching the bib to the garment in both patents cited above is that each garment must be modified to accept the bib. The bib scarf system allows for the bib scarf to be attached to a bib which can be worn all day with any garment and only the bib scarf will be removed after feedings or, if one chooses, the underlying garment (see FIG. 14) can be removed easily. There is no need for adapting each individual garment to accept a bib. The bib-scarf system works with either a neck strap for adults (see FIG. 11) or without a neck strap (see FIG. 14) for use with babies and to be used easily in a car seat with a harness (see FIG. 15 *d*)

SUMMARY AND OBJECTIVES

The present invention came about as a solution to have a bib that would readily adjust under the chin and around the neck to keep drool off the neck and chin and the subsequent wetting of the garment around the neck It was also the purpose of the invention to be a bib that is flexible and adjustable in size of width and length by merely adjusting the amount of material pulled through the center opening as well as the ability to spread the material out horizontally or pleat it by hand for a more narrow profile. It was the purpose of the invention to be simple to make with little sewing and few parts.

As shown in the drawings section, these objectives were rendered by the simple invention of a piece of material (for inventor's use, a piece of absorbable soft birds eye weave fabric was used), cut into an 18" by 24" rectangle followed by a 4" by ½" horizontal cut in the middle of the fabric. The top of the fabric is then simply pulled through the opening and is adjusted to fluff up and provide a nonplanar bib. The third item needed in the invention is a strap to traverse through the horizontal opening and the fold where the top half of the material has been pulled through the said opening. It was also the purpose of the invention to have the option of being attached to the wearer without having to actually go around the circumference of the neck of the wearer. This feature is the preferred embodiment. The ability to attach the bib-scarf to a pre-made cute outer garment with a strap allows the bib-scarf to be efficiently used with a 5 point harness child carrier without having to be tied around the neck of the baby with snaps, Velcro, buttons or a string. These types of bibs always tend to shift in transport or are pulled off by the baby. In addition, they tend to get caught under the harness straps and do not provide protection of drool on the harness. As shown in FIGS. 15-15D, the bib-scarf system can be worn, and removed, with the child strapped in the harness. There is no attachment around the neck to worry about and the bib-scarf can be changed as often as needed without removing the child. In addition, the system of making the bib-scarf allows for multiple types of fabric and sizes. For example, one could use a soft flannel material which would provide warmth as well as protection from drool when draped over the child in the car seat as shown in FIG. 15D. The system would keep the "blanket" bib-scarf from sliding off as the child is transported in the carrier.

In summary, the present invention is not about the type of material used or the dimensions of the fabricated materials, but about the invention of a method to create a nonplanar, adjustable, flexible bib that can be used with or without going around the circumference of the neck of the wearer. The invention is so simple and only requires a piece (or pieces) of fabric with a horizontal opening and a strap to traverse through the opening and the fold of the material pulled through the opening. The method of fabrication and use is simple and flexible.

DESCRIPTION OF THE DRAWINGS

Figure 1:
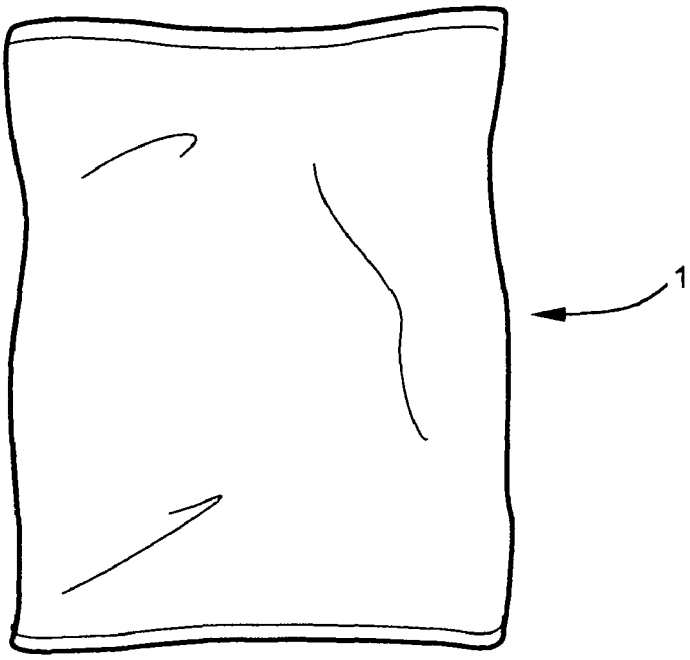
FIG. 1-FIG. 4 depicts one method of creating a horizontal opening in a piece of rectangular fabric by cutting the opening in a single piece of fabric. In addition to creating the necessary opening, it also depicts how the opening defines a top half of material which resides above the opening and a bottom half of material which resides below the opening.

FIG. 1 is a single piece of fabric material (1). The material can vary, as the invention is about the process and not the type of fabric. For purposes of baby bibs, I prefer an absorbent cotton or cotton polyester blend. The fabric (1) is cut to a rectangular shape. The size and shape can vary. For purposes of baby bibs, I prefer a width of 18 inches and a length of 24 inches.

Figure 2:
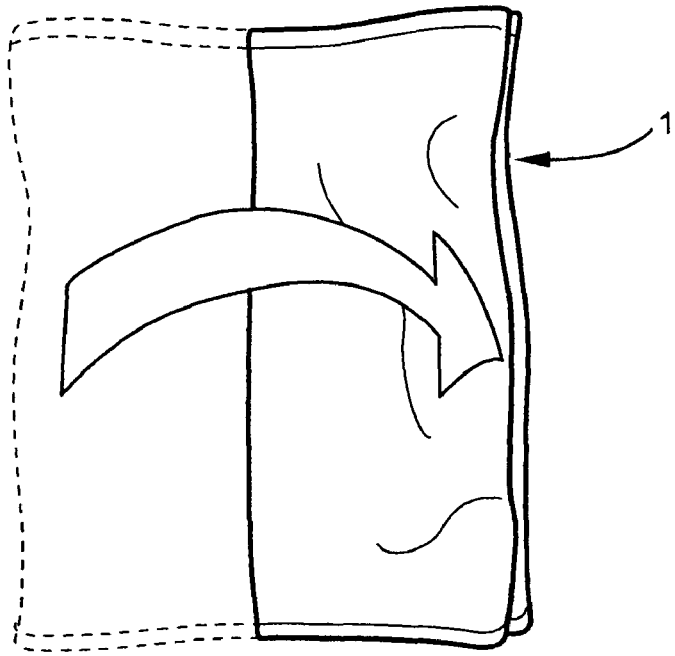

FIG. 2 shows the fabric (1) folded in half.

Figure 3:
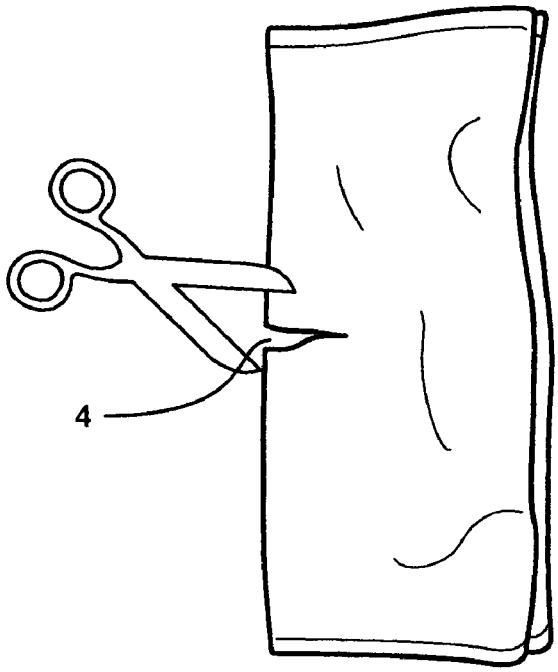

FIG. 3 depicts an opening (4) made in the fabric. The opening (4) can vary in size. I prefer a 4 inch opening (4) made 15 inches from the top of the folded fabric (1) on a piece of fabric 18" wide and 24" long.

Figure 4:
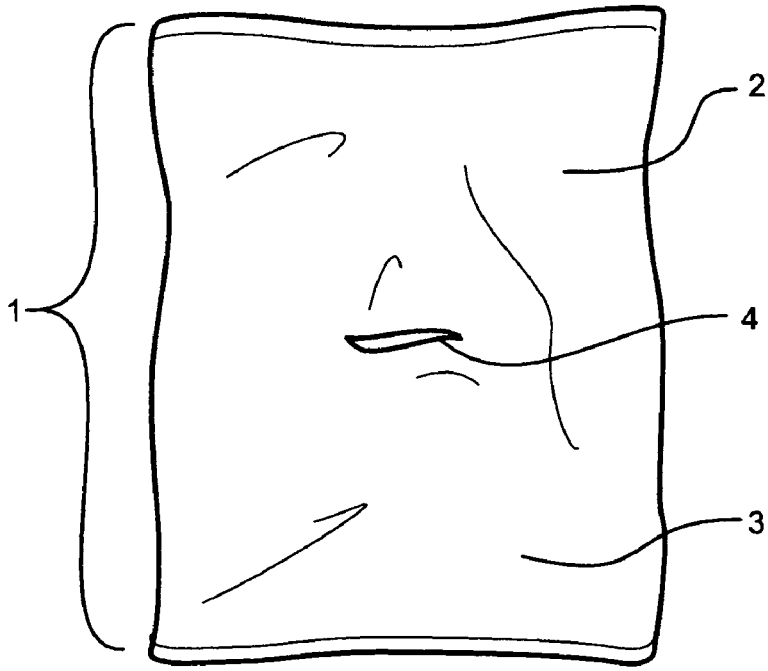

FIG. 4 shows fabric (1) unfolded. The opening (4) separates the fabric (1) into a top portion (2) and a bottom portion (3).

Figure 5A:
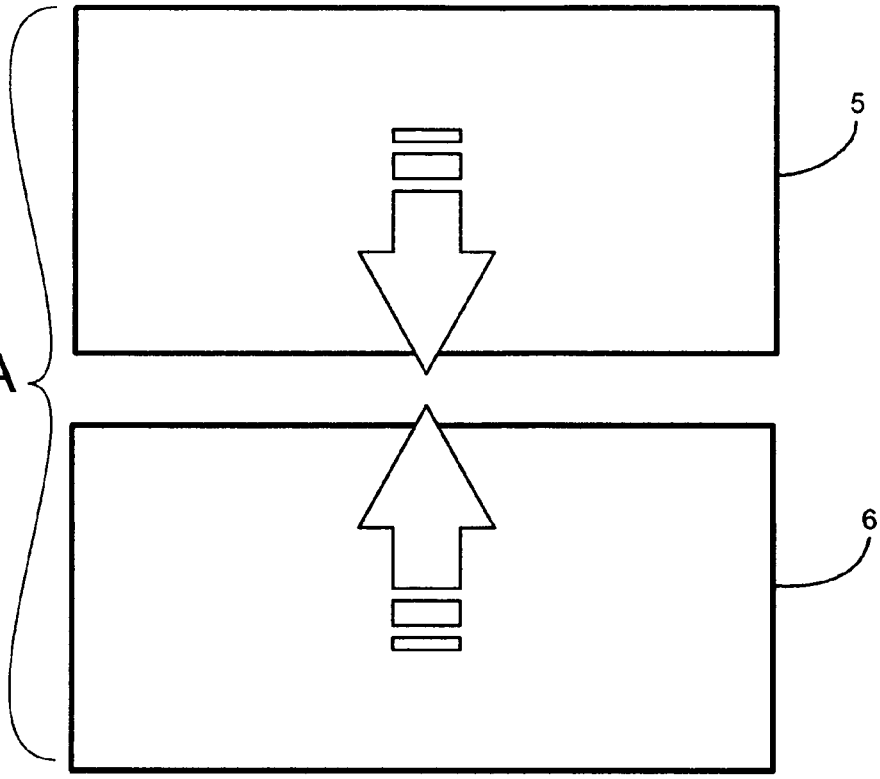
FIG. 5A-FIG. 5B depicts an alternative way of creating a horizontal opening in a piece of rectangular fabric by using two pieces of fabric and sewing them together to create an opening.

FIG. 5A shows an alternative method of creating a top and bottom portion of fabric with an opening (4) in the middle of the fabric. This is a way to allow 2 different types of fabric or the same fabric with the front and back reversed to come together with an opening (4) in the middle. The top portion (5) is placed facing the bottom portion (6).

Figure 5B:
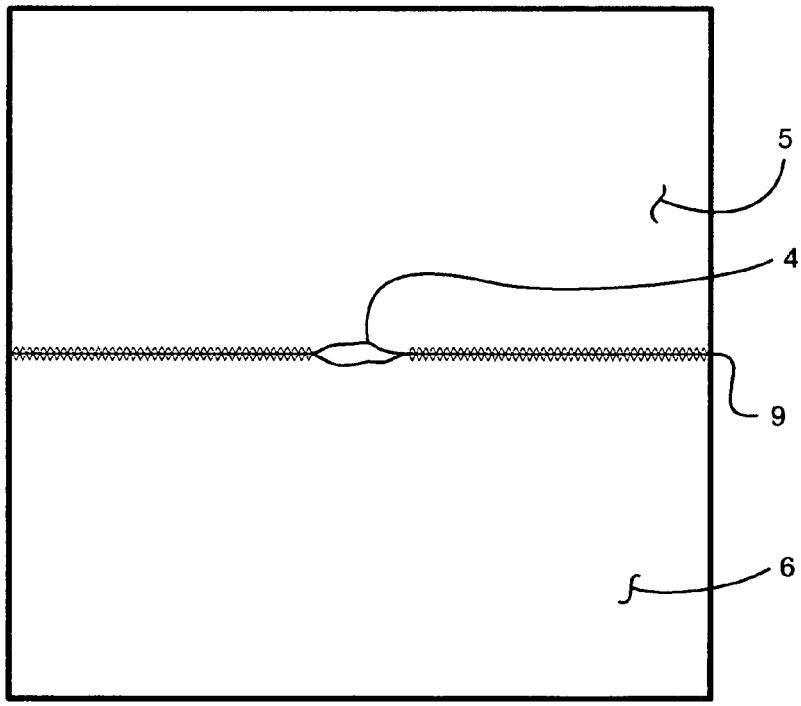

FIG. 5B shows the top portion of fabric (5) stitched (9) together with the bottom portion of fabric (6) creating the opening (4).

Figure 6A:
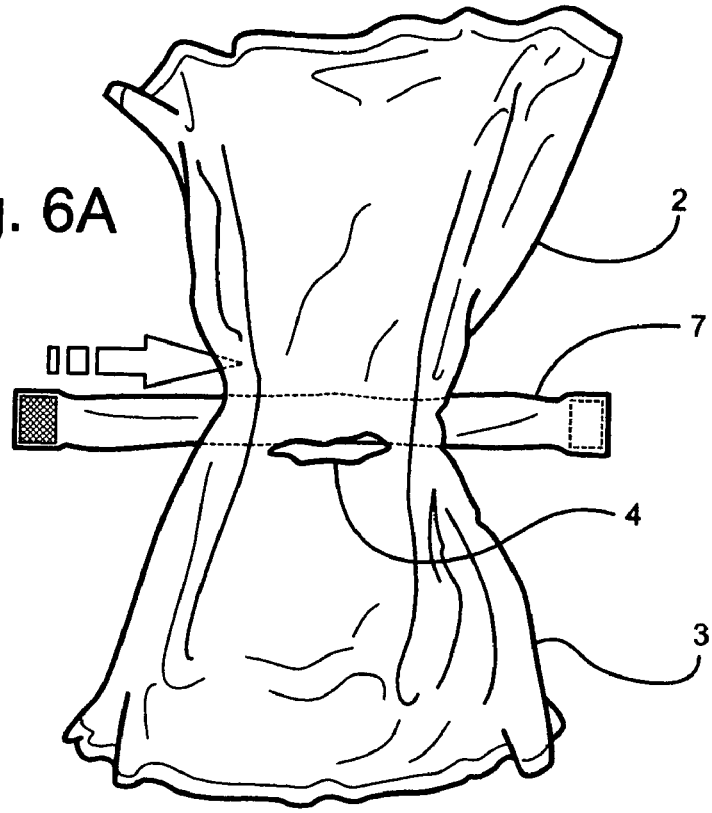
FIG. 6A-FIG. 8 depicts a method of positioning a strap and pulling the top half of the fabric through the opening and catching the strap.

FIG. 6A shows the embodiment of FIG. 4 placed over a horizontal band of material (7) with the opening (4) centered left to right on the band of material (7).

Figure 6B:
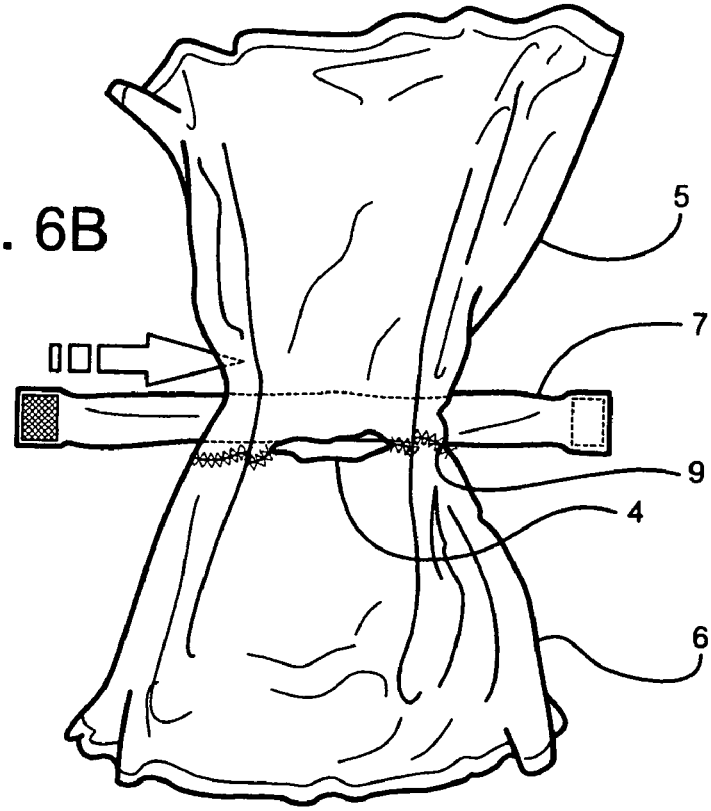

FIG. 6B shows the embodiment of FIG. 5B placed over the horizontal band of material (7).

Figure 7:
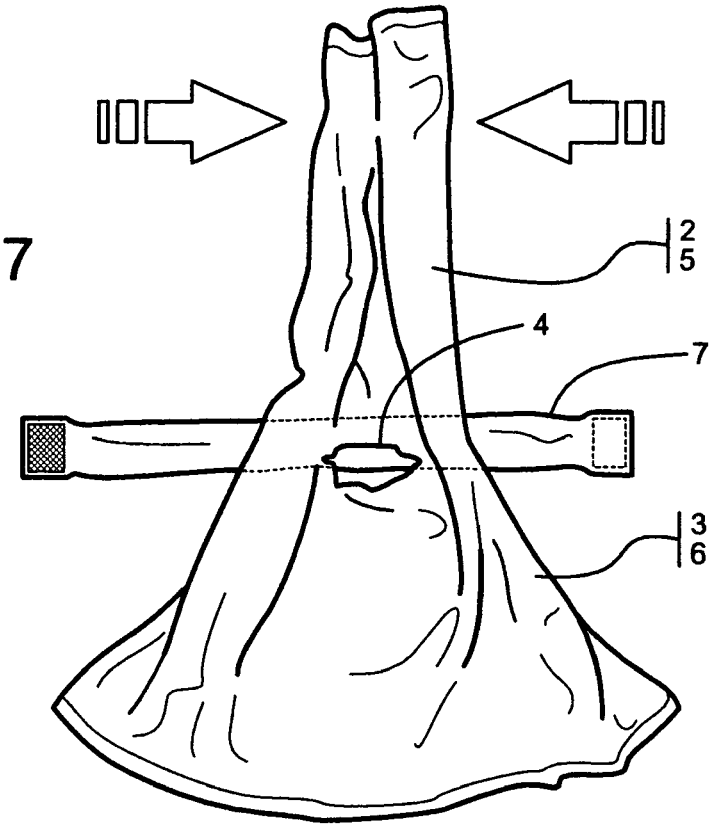

FIG. 7 shows the process of taking the left and right sides of the top portion of fabric (2) or (5) and gathering both sides toward the middle of top portion of fabric (2) or (5).

Figure 8:
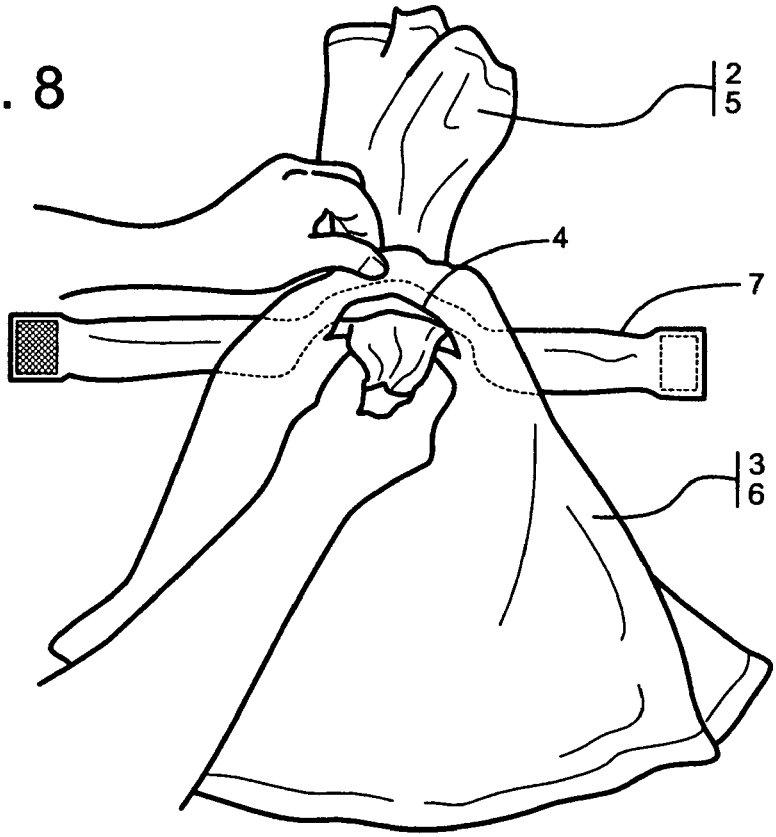

FIG. 8 shows the gathered piece of top fabric (2) or (5) folded back on itself and pulled behind and under the band of material (7) and through the opening (4).

Figure 9:
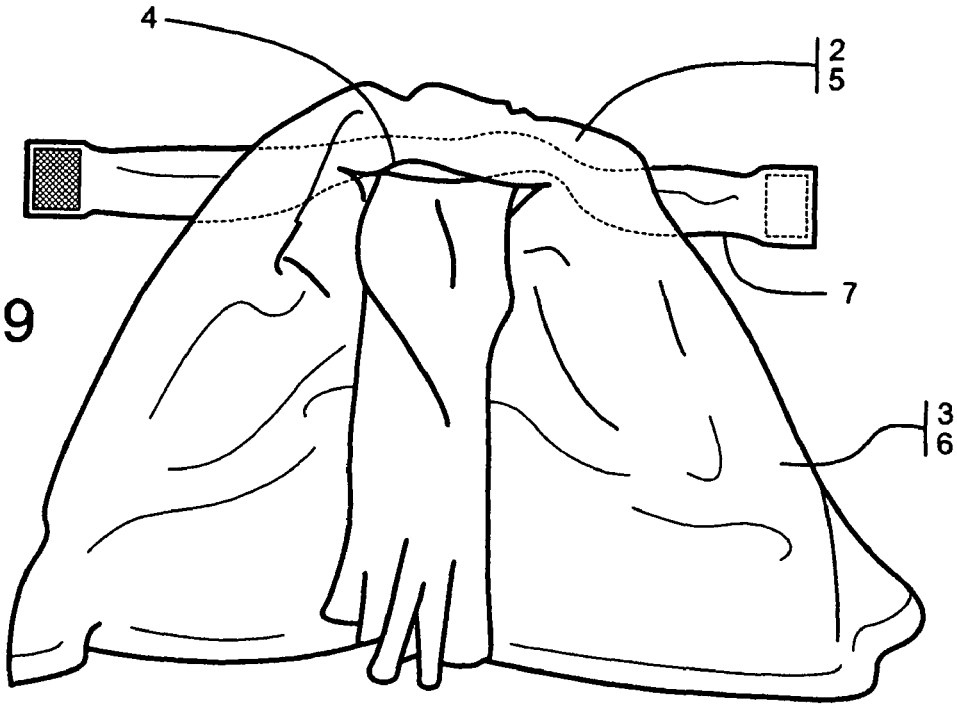
FIG. 9 depicts the fabric securely attached to the strap.

FIG. 9 shows the top portion of fabric (2) or (5) resting securely on the band (7) and on top of the bottom portion of the fabric (3) or 6).

Figure 10:
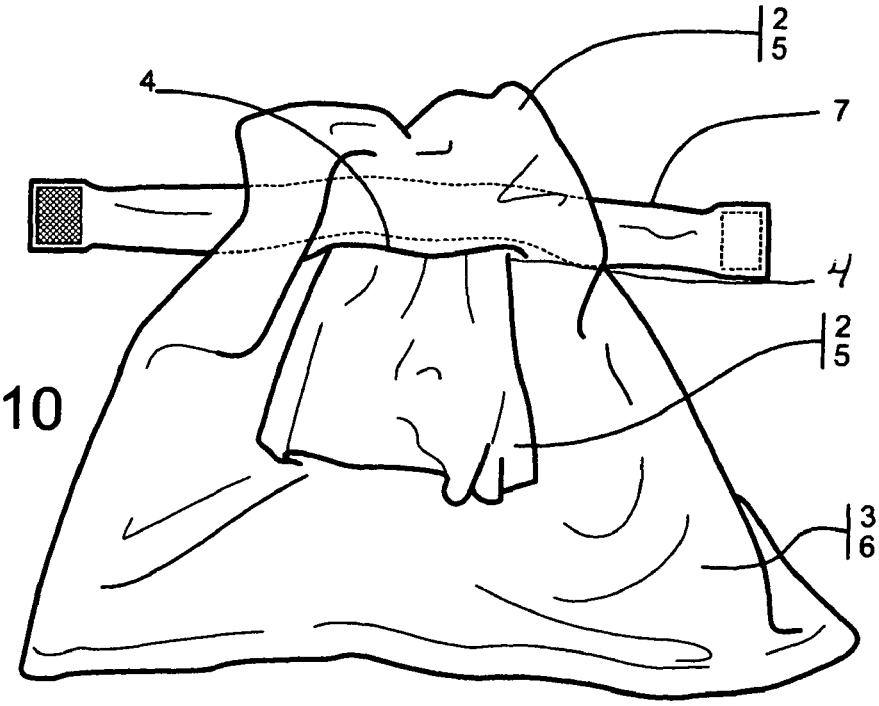
FIG. 10 depicts the fabric adjusted so as to fluff it up around the wearer's neck

FIG. 10 shows the top portion of the fabric (2) or (5) pulled back through the opening (4) to allow for more area of the top portion of fabric (2) or (5) to be above the band (7) if desired.

Figure 11:
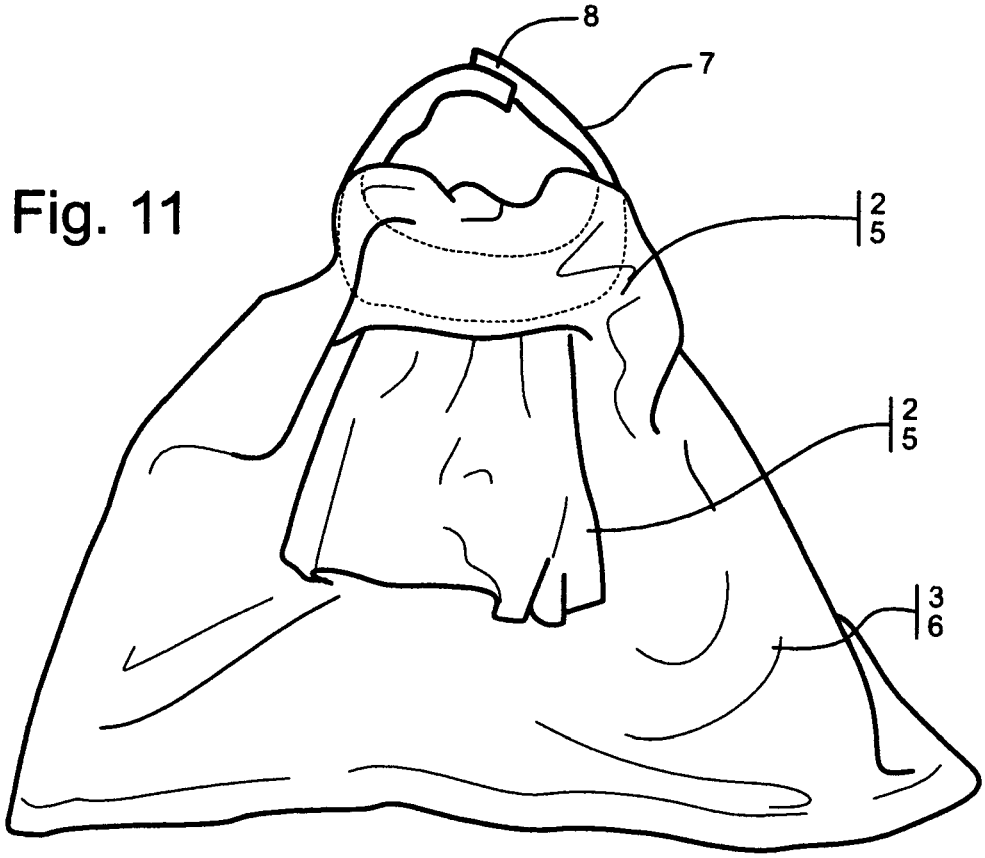
FIG. 11 depicts one way of attaching the bib to the wearer by using the strap as a necklace.

FIG. 11 shows the band of material (7) attached to itself with some type of attachment (8). This embodiment is one way of wearing the bib-scarf. The bib-scarf can now be worn around the neck of the wearer as shown assembled in FIG. 9 and FIG. 10.

Figure 12:
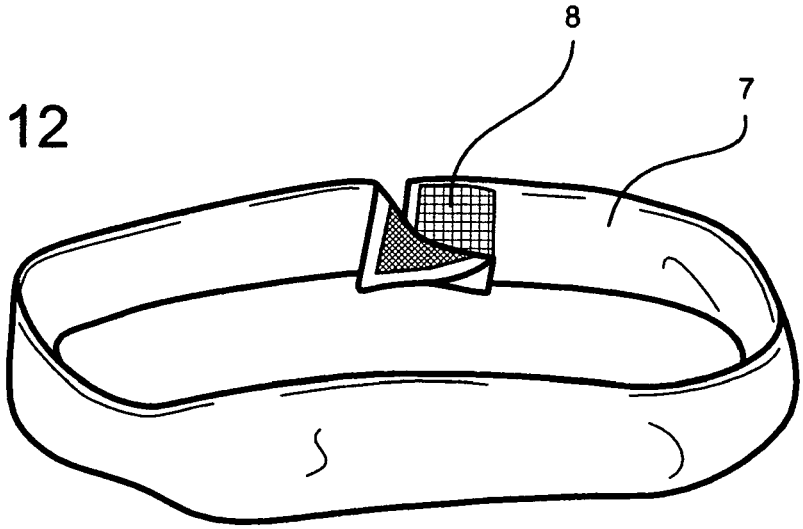
FIG. 12 depicts a method of attaching the strap to itself, thus creating a necklace.

FIG. 12 is an example of a band of material (7) with an attachment (8) creating a circular neck band. In this embodiment Velcro was used at the ends of a soft terry cloth band of material. Any type of material and fasteners can be used.

Figure 13:
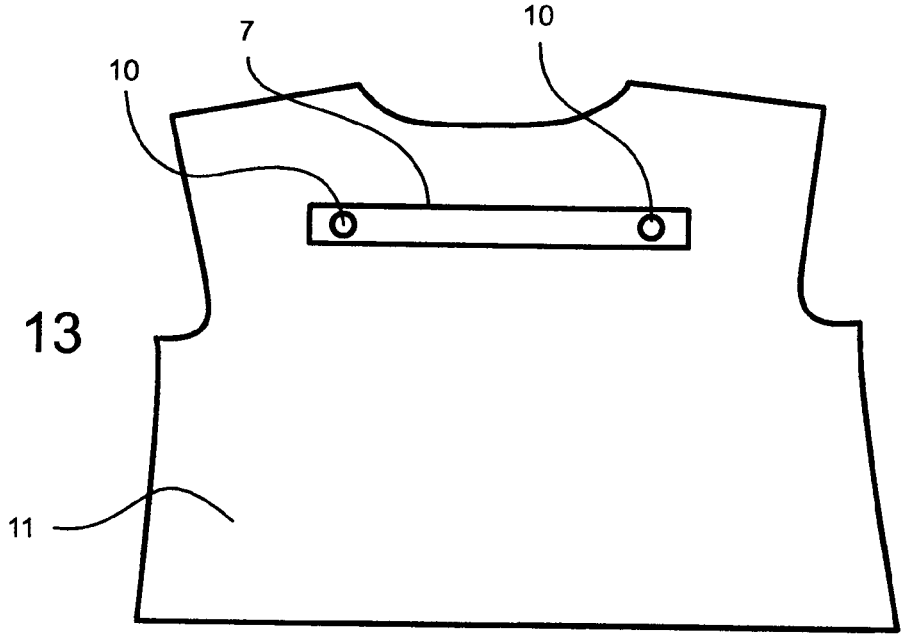
FIG. 13 depicts an outer garment with a removable strap that allows the bib to be attached without going around the neck of the wearer.

FIG. 13 is an alternate embodiment of a band of material (7). This shows the band of material (7) attached to a garment (11) instead of attached to itself as in FIG. 12. In FIG. 13 the band is attached to the garment (10) either permanently as stitched down or removable as in snaps, buttons, or Velcro. For bib purposes I prefer to have at least one side removable from the garment (11) (such as a snap (10) so that the bib can slide on and off the band of material (7) horizontally prior and after use instead of pulling it back through the opening (4). This keeps it out of the wearer's face should the garment be on the wearer.

Figure 14:
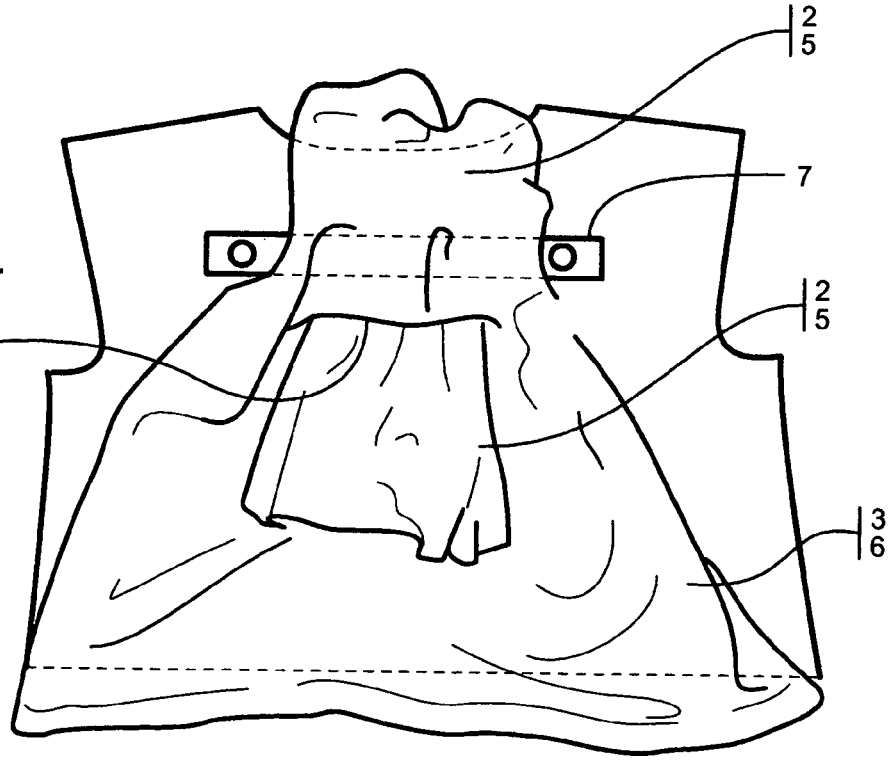
FIG. 14 depicts how the strap is slid through the opening of the fabric after the top half of the fabric has been pulled through the opening. This is an alternative way of catching the strap as the top half of the material is pulled through the horizontal opening of the fabric prior to catching the strap as depicted in FIG. 6A-FIG. 8

FIG. 14 shows the fabric (2) or (5) pulled behind the band (7) and through the opening (4) and resting on the bottom portion of the fabric (3) or (6). Although FIG. 14 shows the top portion of the fabric (2) or (5) resting narrowly above the band (7), the top portion (2) or (5) can be pulled up and expanded both horizontally and vertically above the band (7) for more coverage of the horizontal top part of the garment (11). This is part of the simplicity and flexibility of the bib-scarf system.

Figure 15A:
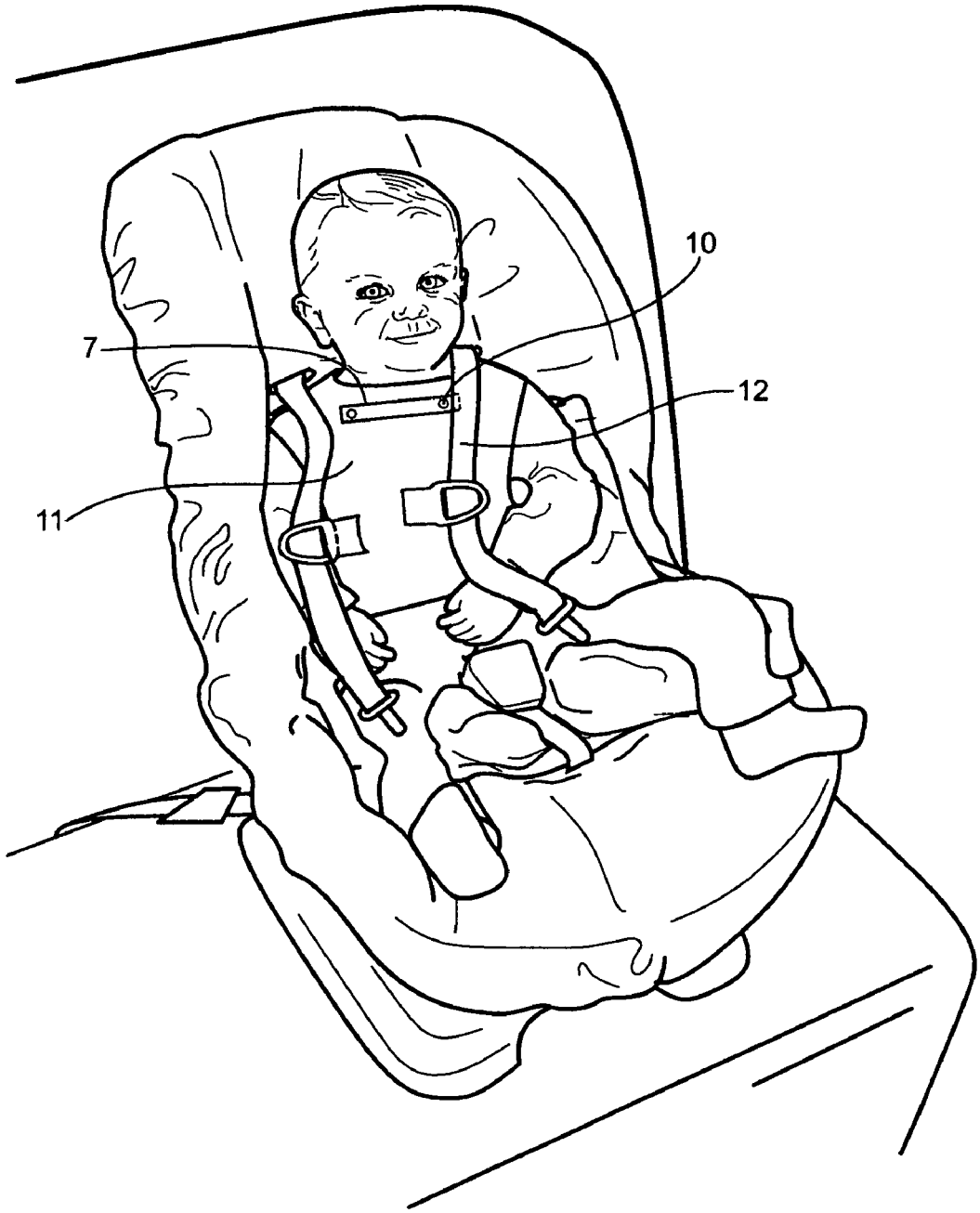
FIG. 15-15D depicts a preferred use of the bib-scarf system. It utilizes the bib garment in FIG. 14. The strap is unsnapped on one side and the fabric, which already has the top half pulled through the opening, is slid through the opening. The carrier harness is then secured and the bib-scarf is adjusted to spread out over the neck and body of the child. The bib-scarf also covers the harness keeping it clean from dribble and drool.

FIG. 15A represents how the product can be used in a car seat harness (12). It shows only the bib component of the bib-scarf system (11) as used in conjunction with a typical 5-point harness car seat (12). This drawing depicts step one of installing the product in the car seat harness (12) with said harness system (12) shown unfastened, showing only the bib component of the bib-scarf system (11) (having the strap of material (7) which is held in place by the two fasteners (10)) having been already placed on the wearer.

Figure 15B:
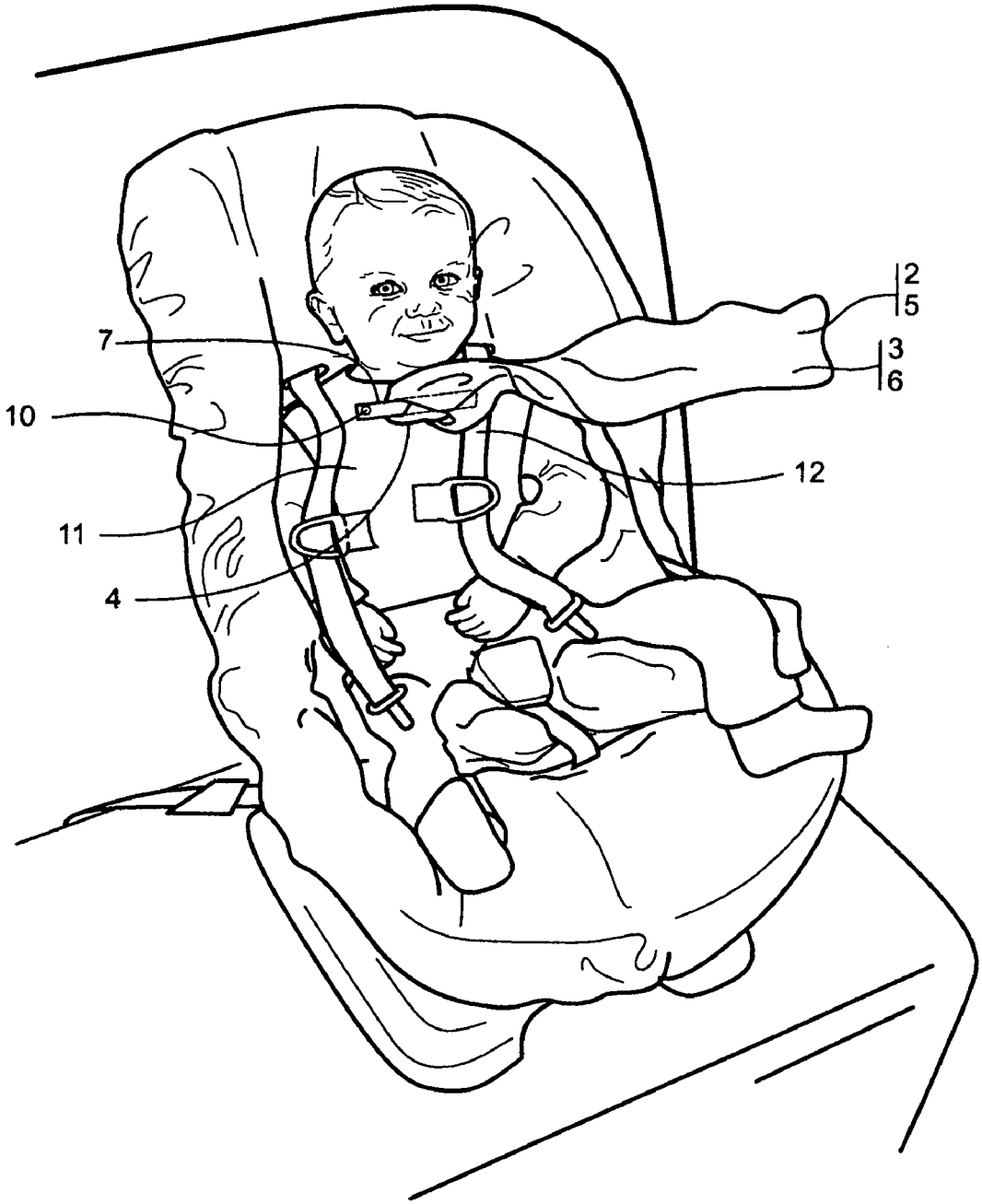

FIG. 15B represents step two and shows the scarf component (2)(5)(3)(6) of the bib-scarf system (11) already drawn through it's own opening (4) and then properly tucked behind the band of material (7) (which is attached to the bib-scarf system (11) by way of fasteners (10)) as previously depicted in FIG. 14. As in FIG. 15A the harness system (12) is shown unfastened and, for illustrative purposes, the scarf portion (2)(5)(3)(6) is shown bundled together and pulled to the side.

Figure 15C:
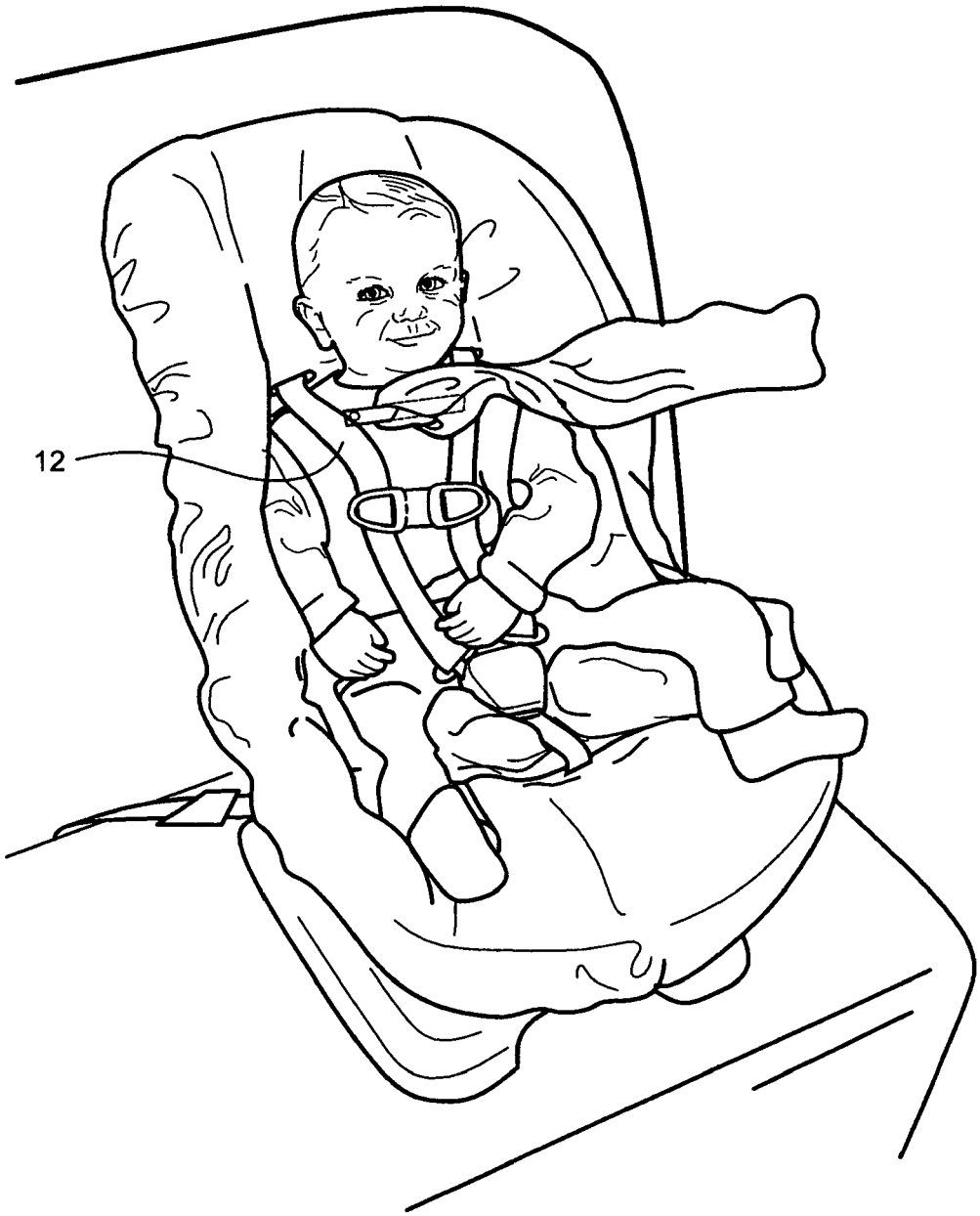

FIG. 15C represents exactly what is shown in FIG. 15B except that it shows the 5-point harness system (12) in its fastened position.

Figure 15D:
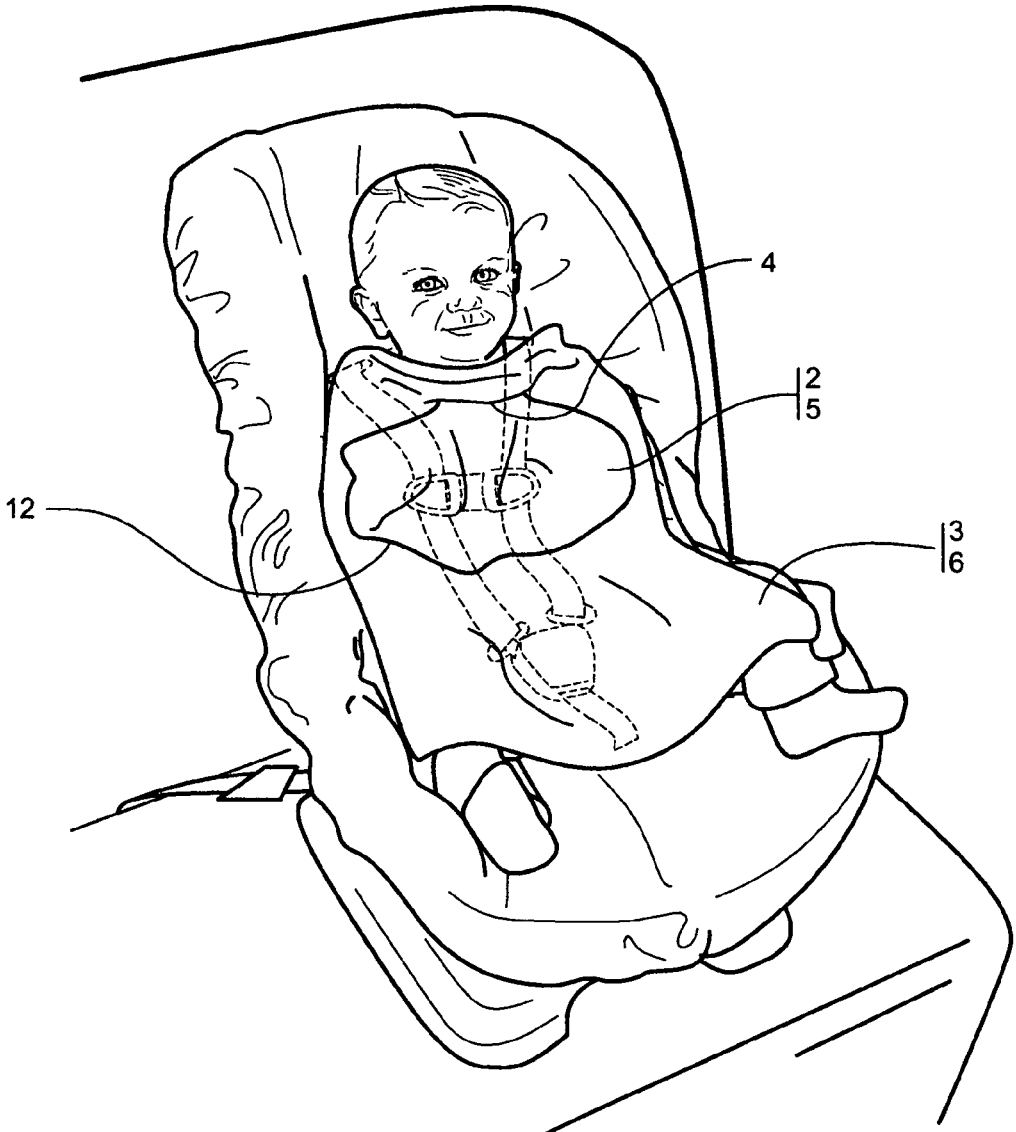

FIG. 15D represents the completed installation, showing the top portion of the scarf (2) (5) of the bib-scarf system (11) drawn through the opening (4) and then pulled out and expanded widely as it rests on the bottom portion of the scarf (3) (6) of the bib-scarf system (11), which also has been expanded to a width appropriate to the width of the wearer.

What is claimed is:

1. A non-planar dribble bib, the bib comprising:

a predetermined sized body section with a neck opening and a panel of fabric under the neck opening, a strap having a first end and a second end, the strap being attached horizontally to a front of said panel of fabric of said body section by sewing at the first end of the strap and by a releasable fastener at the second end of the strap, a mating fastener on the front of said panel of fabric for releasably securing the fastener of the second end of the strap thereto, a handkerchief with a horizontally oriented hole in the center, said hole forming a means of attaching said handkerchief to said body section without sewing or the use of additional fasteners, wherein the handkerchief comprises a piece of fabric having a top portion, a bottom portion, a left side, and a right side, the handkerchief configured such that it is attached to said body section by gathering the sides of the top portion of the handkerchief fabric together from both the left side and the right side towards the middle of said fabric, so as to make the width of the top portion of said handkerchief fabric narrow enough to fit through the opening of the horizontal hole, then folding the top portion of said handkerchief backwards and down against itself, then pulling the to portion of the handkerchief through the rear of the opening of the horizontal hole, unfastening the second end of said strap which is attached to the body section by said fasteners, threading said strap from back to front through a left side of the horizontal hole, laying said strap across the top portion of said handkerchief fabric, and then feeding said strap back through a right side of the horizontal hole from front to back, and then fastening the strap by attaching the second end of the strap to the body section by connecting said releasable fastener and said mating fastener.

2. The non-planar dribble bib according to claim 1, wherein the panel of fabric is sized to fit over the chest of a wearer, with a top and bottom vertically oriented and a right and left side horizontally oriented under said neck opening.

3. The non-planar dribble bib according to claim 2, wherein said mating fastener is a piece of hook material sewn below said neck opening of the predetermined sized body section and adjacent an end of said right side of said panel of fabric of said body section.

4. The non-planar dribble bib according to claim 1, wherein the strap is of a non-stretchy fabric.

5. The non-planar dribble bib according to claim 4, wherein said releasable fastener is a piece of loop material sewn onto the second end of said strap.

6. The non-planar dribble bib according to claim 1, wherein said handkerchief is a piece of absorbent fabric cut in a rectangular shape, vertically oriented, and said horizontal hole is cut in the center of said fabric approximately two thirds of the way down from a top of said fabric to a bottom of said fabric, thereby creating a top portion of fabric above the horizontal hole and a bottom portion of said fabric below the hole.

* * * * *